US011998082B2

(12) United States Patent
Patton

(10) Patent No.: US 11,998,082 B2
(45) **Date of Patent: *Jun. 4, 2024**

(54) ADJUSTABLE FOOT SUPPORT SYSTEMS INCLUDING FLUID-FILLED BLADDER CHAMBERS

(71) Applicant: NIKE, Inc., Beaverton, OR (US)

(72) Inventor: Levi J. Patton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 126 days.

This patent is subject to a terminal disclaimer.

(21) Appl. No.: 17/509,105

(22) Filed: Oct. 25, 2021

(65) Prior Publication Data

US 2022/0039513 A1 Feb. 10, 2022

Related U.S. Application Data

(63) Continuation of application No. 16/105,170, filed on Aug. 20, 2018, now Pat. No. 11,166,523.

(60) Provisional application No. 62/547,941, filed on Aug. 21, 2017.

(51) Int. Cl.

| | |
|---|---|
| ***A43B 13/20*** | (2006.01) |
| ***A43B 3/34*** | (2022.01) |
| ***A43B 13/18*** | (2006.01) |

(52) U.S. Cl.

CPC ..... *A43B 13/203* (2013.01); *A43B 3/34* (2022.01); *A43B 13/186* (2013.01); *A43B 13/206* (2013.01)

(58) Field of Classification Search

CPC ..... A43B 13/20; A43B 13/203; A43B 13/206; A43B 3/34; A43B 13/186

USPC ..... 36/29, 35 B, 153

See application file for complete search history.

(56) References Cited

U.S. PATENT DOCUMENTS

| | | | | |
|---|---|---|---|---|
| 5,179,792 | A | 1/1993 | Brantingham | |
| 5,813,142 | A | 9/1998 | Demon | |
| 5,893,219 | A * | 4/1999 | Smith | A43B 23/029 36/3 R |
| 6,430,843 | B1 | 8/2002 | Potter et al. | |
| 7,107,706 | B1 | 9/2006 | Bailey, Sr. et al. | |

(Continued)

FOREIGN PATENT DOCUMENTS

| | | | |
|---|---|---|---|
| CN | 105188448 | A | 12/2015 |
| CN | 205233604 | U | 5/2016 |

(Continued)

OTHER PUBLICATIONS

English machine translation of WO 2017101902 A1. via espacenet.com. Translation performed Aug. 12, 2020. (Year: 2017).*

(Continued)

*Primary Examiner* — Jameson D Collier

(74) *Attorney, Agent, or Firm* — Banner & Witcoff, Ltd.

(57) ABSTRACT

Foot support systems for articles of footwear or other foot-receiving devices include a compressor or other gas source used to control gas pressure provided in one or more pressure adjustable fluid-filled bladders used to support a wearer's foot. Additional features relate to fluid flow control systems and methods that include a plurality of valves to control an inflation configuration for supplying gas to the one or more adjustable fluid filled bladders or a deflation configuration for releasing gas from the one or more adjustable fluid filled bladders.

16 Claims, 10 Drawing Sheets

(56) References Cited

U.S. PATENT DOCUMENTS

| | | | | |
|---|---|---|---|---|
| 7,219,449 | B1 * | 5/2007 | Hoffberg | A43B 3/0026 36/88 |
| 7,448,150 | B1 | 11/2008 | Davis et al. | |
| 9,339,074 | B2 | 5/2016 | Ellis | |
| 11,166,523 | B2 | 11/2021 | Patton | |
| 11,510,458 | B2 * | 11/2022 | Bailly | A43B 13/206 |
| 2006/0196081 | A1 | 9/2006 | Lee | |
| 2006/0248750 | A1 | 11/2006 | Rosenberg | |
| 2007/0129907 | A1 | 6/2007 | Demon | |
| 2011/0067264 | A1 | 3/2011 | Doyle | |
| 2011/0131839 | A1 | 6/2011 | Ballin et al. | |
| 2014/0137965 | A1 * | 5/2014 | Truitt | A43B 3/0078 156/308.2 |
| 2014/0165427 | A1 | 6/2014 | Molyneux et al. | |
| 2017/0172249 | A1 * | 6/2017 | Kassatly | A43B 7/00 |
| 2020/0170343 | A1 * | 6/2020 | Bailly | A43B 3/34 |
| 2021/0368938 | A1 * | 12/2021 | Browne | A43B 13/189 |
| 2022/0104582 | A1 * | 4/2022 | Christensen | A43B 23/029 |

FOREIGN PATENT DOCUMENTS

| | | | |
|---|---|---|---|
| CN | 106873423 | A | 6/2017 |
| DE | 102015225209 | A1 | 6/2017 |
| JP | S59195261 | U | 12/1984 |
| JP | S60108858 | A | 7/1985 |
| JP | H07127753 | A | 5/1995 |
| JP | 2005506862 | A | 3/2005 |
| JP | 2008504857 | A | 2/2008 |
| KR | 100744646 | B1 | 8/2007 |
| WO | 9009115 | A1 | 8/1990 |
| WO | 2008051164 | A1 | 5/2008 |
| WO | 20110131839 | A1 | 10/2011 |
| WO | 2017101902 | A1 | 6/2017 |

OTHER PUBLICATIONS

Nov. 16, 2018—(WO) ISR & WO—App. No. PCT/US18/047045.
Sep. 30, 2022—(EP) EESR—App. No. 22184194.3.

* cited by examiner

ADJUSTABLE FOOT SUPPORT SYSTEMS INCLUDING FLUID-FILLED BLADDER CHAMBERS

RELATED APPLICATION DATA

This application is a continuation of U.S. patent application Ser. No. 16/105,170 filed Aug. 20, 2018, now allowed, which claims priority benefits to, and is a U.S. Non-Provisional patent application of, U.S. Provisional Patent Appln. No. 62/547,941 filed Aug. 21, 2017 and entitled "Adjustable Foot Support Systems Including Fluid-Filled Bladder Chambers." Both applications are entirely incorporated herein by reference.

FIELD OF THE INVENTION

The present invention relates to foot support systems in the field of footwear or other foot-receiving devices. More specifically, aspects of the present invention pertain to foot support systems, e.g., for articles of footwear, that include one or more pressure adjustable fluid-filled bladders.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY OF THE INVENTION

This Summary is provided to introduce some general concepts relating to this invention in a simplified form that are further described below in the Detailed Description. This Summary is not intended to identify key features or essential features of the invention.

Aspects of this invention relate to the foot support systems, articles of footwear, and/or other foot-receiving devices having one or more pressure adjustable fluid-filled bladders, e.g., of the types described and/or claimed below and/or of the types illustrated in the appended drawings. Such foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

While some aspects of the invention may be described in terms of foot support systems, additional aspects of this invention relate to articles of footwear, methods of making such foot support systems and/or articles of footwear, and/or methods of using such foot support systems and/or articles of footwear, e.g., in the various manners described below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
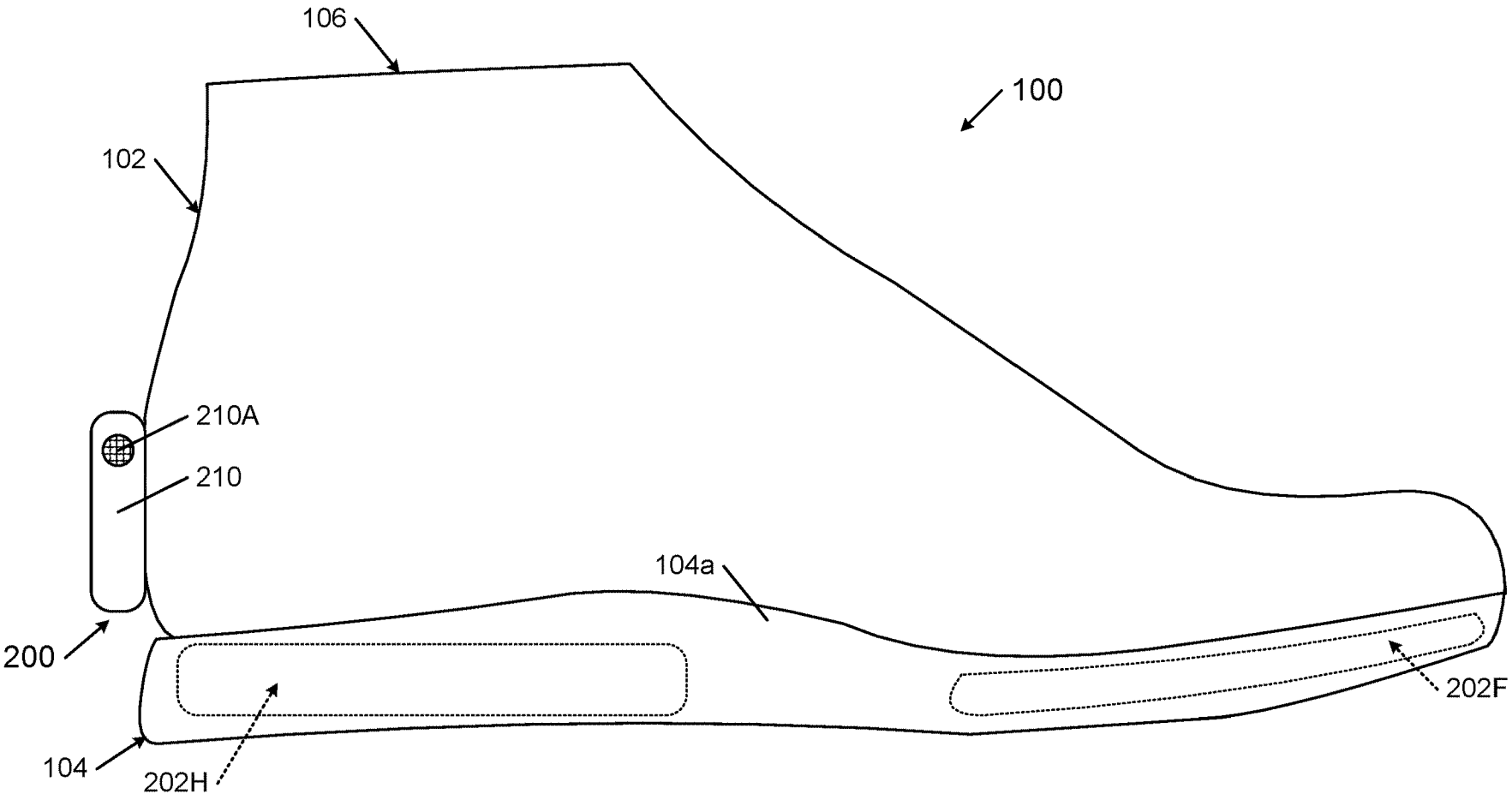
FIGS. 1A-1C provide various views showing an article of footwear including foot support systems in accordance with at least some examples of this invention.

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made to the specifically described structures and methods without departing from the scope of the present invention.

I. General Description of Aspects of this Invention

As noted above, aspects of this invention relate to foot support systems, articles of footwear, and/or other foot-receiving devices having one or more pressure adjustable fluid-filled bladders, e.g., of the types described and/or claimed below and/or of the types illustrated in the appended drawings. Such foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Some aspects of this invention relate to foot support systems for articles of footwear or other foot-receiving devices that include one or more of: (a) a compressor including a gas intake port and a gas outlet port; (b) a first solenoid valve including a gas intake port in fluid communication with the gas outlet port of the compressor (optionally through another solenoid valve) and a gas outlet port, wherein the first solenoid valve includes a first movable plunger that moves to change the first solenoid valve at least between an inflation configuration and a deflation configuration; (c) a first fluid-filled bladder configured to support at least a portion of a plantar surface of a user's foot (e.g., a heel area, a forefoot area, etc.), wherein the first fluid-filled bladder includes a gas port; and/or (d) a first fluid line connecting the gas outlet port of first solenoid valve and the gas port of the first fluid-filled bladder. The first fluid-filled bladder (a) receives gas from the first solenoid valve when the first solenoid valve is in the inflation configuration and (b) discharges gas (optionally through the first solenoid valve) when the first solenoid valve is in the deflation configuration.

Other aspects of this invention relate to foot support systems for articles of footwear or other foot-receiving devices that include one or more of: (a) a compressor including a gas intake port and a gas outlet port; (b) a first fluid-filled bladder configured to support at least a first portion of a plantar surface of a user's foot, wherein the first fluid-filled bladder includes a first gas port; (c) a second fluid-filled bladder configured to support at least a second portion of a plantar surface of a user's foot, wherein the second fluid-filled bladder includes a second gas port; (d) a first solenoid valve including a gas inlet port, a first gas outlet port, and a second gas outlet port; (e) a first fluid line connecting the gas outlet port of the compressor with the gas inlet port of the first solenoid valve; (f) a second fluid line connected to the first gas outlet port of the first solenoid valve and in fluid communication with the first gas port of the first fluid-filled bladder; and/or (g) a third fluid line connected to the second gas outlet port of the first solenoid valve and in fluid communication with the second gas port of the second fluid-filled bladder. The first solenoid valve of this system may be configured to be changeable at least between: (a) a first configuration in which gas discharged from the compressor is transmitted to the first fluid-filled bladder and (b) a second configuration in which gas discharged from the compressor is transmitted to the second fluid-filled bladder. Optionally, the first solenoid valve additionally may be configured to be changeable to a third configuration in which gas discharged from the compressor is transmitted to the first fluid-filled bladder and the second fluid-filled bladder simultaneously. The first fluid-filled bladder and the second fluid-filled bladder need not be in fluid communication with one another in any one or more of these noted configurations.

Still other aspects of this invention relate to foot support systems for articles of footwear or other foot-receiving devices that include one or more of: (a) a compressor including a gas intake port and a gas outlet port; (b) a first solenoid valve including a gas intake port, a first gas outlet port, and a second gas outlet port; (c) a first fluid line connecting the gas outlet port of the compressor with the gas intake port of the first solenoid valve; (d) a second solenoid valve including a gas intake port and a gas outlet port; (e) a second fluid line connecting the first gas outlet port of the first solenoid valve with the gas intake port of the second solenoid valve; (f) a third solenoid valve including a gas intake port and a gas outlet port; (g) a third fluid line connecting the second gas outlet port of the first solenoid valve with the gas intake port of the third solenoid valve; (h) a first fluid-filled bladder configured to support at least a first portion of a plantar surface of a user's foot, wherein the first fluid-filled bladder includes a gas port; (i) a fourth fluid line connecting the gas outlet port of the second solenoid valve with the gas port of the first fluid-filled bladder; (j) a second fluid-filled bladder configured to support at least a second portion of a plantar surface of a user's foot, wherein the second fluid-filled bladder includes a gas port; and/or (k) a fifth fluid line connecting the gas outlet port of the third solenoid valve with the gas port of the second fluid-filled bladder. This first solenoid valve may be configured to be changeable at least between: (a) a first configuration in which gas discharged from the compressor is transmitted to the second solenoid valve and (b) a second configuration in which gas discharged from the compressor is transmitted to the third solenoid valve (and optionally to a third configuration in which gas discharged from the compressor is transmitted to the second solenoid valve and the third solenoid valve simultaneously). Additionally or alternatively, the second solenoid valve and/or the third solenoid valve may be configured to be changeable between (a) an inflation configuration (in which gas is transferred into its respective connected fluid-filled bladder) and (b) a deflation configuration (in which gas is discharged from its respective connected fluid-filled bladder, optionally through a port provided in the solenoid valve).

Given the general description of example features, aspects, structures, processes, and arrangements according to certain embodiments of the invention provided above, a more detailed description of specific example foot support structures, articles of footwear, and methods in accordance with this invention follows.

Figure 1B:
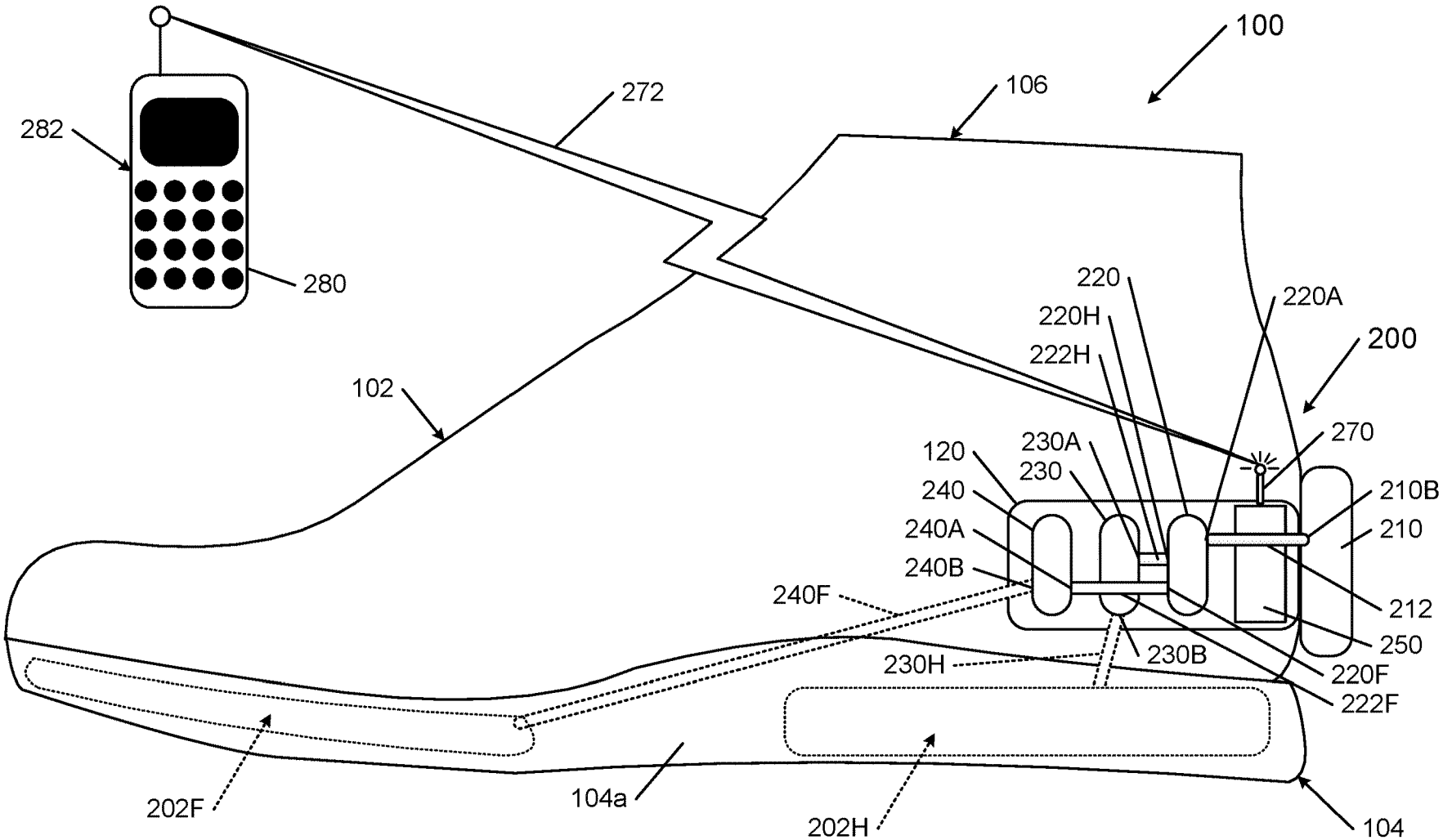
Figure 1C:
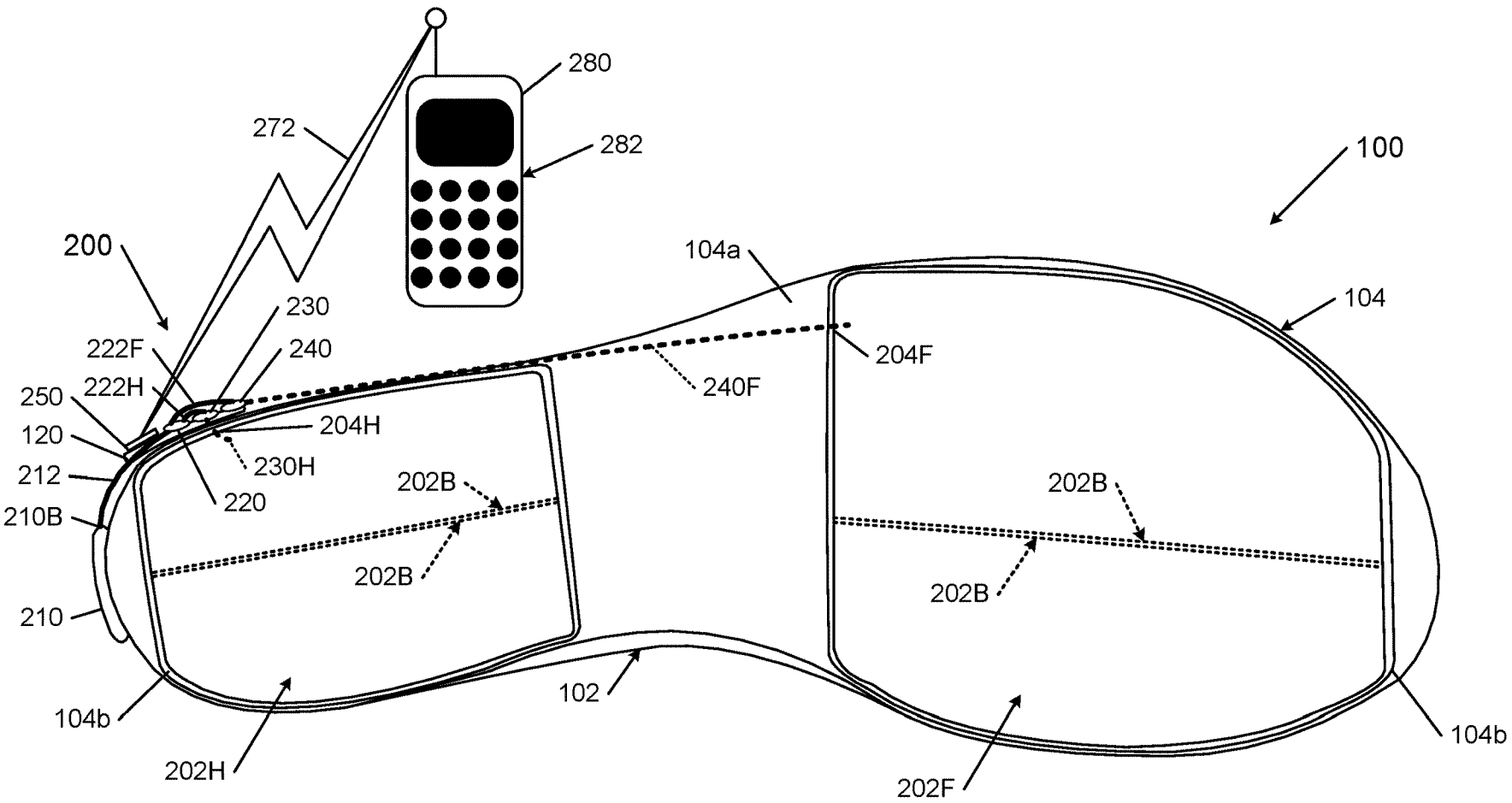

II. Detailed Description of Example Foot Support Systems and Other Components/Features According to this Invention Referring now to FIGS. 1A-1C, an example article of footwear 100 and/or foot support system 200 in accordance with at least some examples of this invention will be described in more detail. FIG. 1A provides a medial side view of this example article of footwear 100, FIG. 1B provides a lateral side view, and FIG. 1C shows a bottom view (with the bottom outsole component removed and/or the foot support components otherwise exposed to provide visual access to the interior foot support structures). The article of footwear 100 may include a footwear upper 102 and a sole structure 104. The footwear upper 102 may be made at least in part by conventional components, in conventional constructions (e.g., from one or multiple parts), without departing from this invention, including one or more parts made of leather, textiles, polymeric materials, metals, and the like. The sole structure 104 also may be made at least in part by conventional components, in conventional constructions (e.g., from one or multiple parts), without departing from this invention, including one or more parts forming a midsole impact force attenuating system (optionally including one or more polymeric foam components) and/or an outsole (optionally including one or more rubber or TPU outsole parts, one or more cleats, etc.). The sole structure 104 may include recesses, openings, or other structures into which the fluid-filled bladder(s) of foot support systems in accordance with at least some examples and aspects of this invention may be received. As some more specific examples, the fluid-filled bladder(s) of the present invention may be received in one or more recesses formed in a polymeric foam midsole and/or within a plastic "cage" like protective member. At least some of the sole structure 104 components may be made of leather, textiles, polymeric materials, rubbers, metals, and the like. The upper 102 and/or the sole structure 104 form an interior chamber (accessible by a foot-insertion opening 106) for receiving a foot of a wearer.

Footwear 100 in accordance with examples of this invention include one or more fluid-filled bladders as part of a foot support system 200, examples of which will be described in more detail below. The fluid-filled bladder(s) may be engaged with one or more conventional parts of the footwear construction, such as with part of the sole structure 104 (e.g., with a polymer foam midsole impact force attenuating member 104*a*, with a plastic "cage" structure, with an outsole component (e.g., rubber, TPU, etc.), etc.) and/or with part of the upper 102 (e.g., with a strobel member, with a bottom base component of the upper 102, with sides of the upper 102, etc.). If desired, as shown in FIG. 1C, the fluid-filled bladder(s) 202H, 202F may be fit into a recess or opening 104*b* defined in a foam midsole impact force attenuating member 104*a*. While any desired number of individual fluid-filled bladders may be provided in foot support systems 200 in accordance with this invention (e.g., one or more), in this illustrated example, the foot support system 200 includes a heel based fluid-filled bladder 202H (positioned and/or shaped to provide support for at least a portion of a heel area of a wearer's foot) and a forefoot based fluid-filled bladder 202F (positioned and/or shaped to provide support for at least a portion of a forefoot area of a wearer's foot). Rather than a single heel based fluid-filled bladder 202H as shown, the heel area of foot support systems 200 may include multiple heel based fluid-filled bladders (which may be in fluid communication or isolated from one another), such as a medial side heel bladder and a lateral side heel bladder, and/or rather than a single forefoot based fluid-filled bladder 202F as shown, the forefoot area of foot support systems 200 may include multiple forefoot based fluid-filled bladders (which may be in fluid communication or isolated from one another), such as a medial side forefoot bladder and a lateral side forefoot bladder. Examples of potential divisions of heel-based fluid-filled bladder 202H and forefoot-based fluid-filled bladder 202F are shown by broken lines 202B in FIG. 1C.

Fluid-filled bladders (e.g., 202H and/or 202F) for use in foot support systems in accordance with examples of this invention may have any desired structures and/or shapes and/or may be made from any desired materials, including conventional structures and/or shapes and/or conventional materials as are known and used in the footwear art (including structures, shapes, and/or materials used in footwear products commercially available from NIKE, Inc. of Beaverton, OR).

Figure 2A:
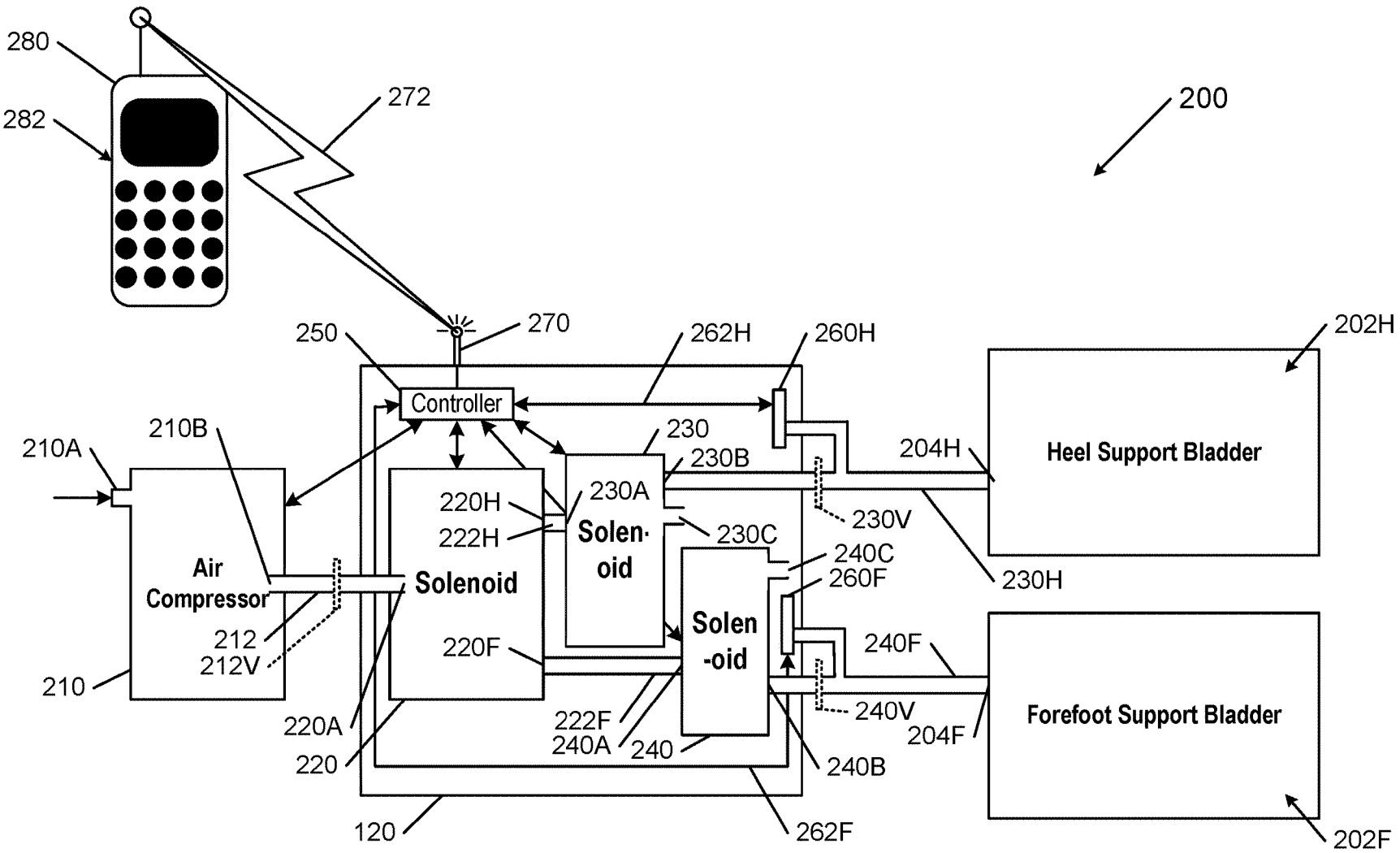
FIG. 2A provides a schematic view of components of foot support systems in accordance with at least some examples of this invention.

Referring now to FIG. 2A in conjunction with FIGS. 1A-1C, additional details of foot support systems 200 in accordance with at least some examples of this invention will be described. As shown in these figures, this example foot support system 200 for an article of footwear 100 (or other foot-receiving device) includes a compressor 210 (e.g., a battery operated air compressor) having a gas intake port 210A and a gas outlet port 210B. The gas intake port 210A, which may include a filter to filter the incoming fluid, may intake air or other gas from its external environment (such as an ambient air source). The compressor 210 may be mounted to the footwear upper 102 and/or the footwear sole structure 104, e.g., to an exterior surface of either or both components, such as by an adhesive, by one or more mechanical connectors, by a bracket (e.g., 120), etc. In this illustrated example, the compressor 210 is mounted at a rear heel area of the footwear upper 102.

A fluid line 212 connects the gas outlet port 210B of the compressor 210 with a gas intake port 220A of a solenoid valve 220. In addition to the gas intake port 220A, this example solenoid valve 220 includes a gas outlet port 220H for supplying fluid to the heel based fluid-filled bladder 202H and another gas outlet port 220F for supplying fluid to the forefoot based fluid-filled bladder 202F.

In this illustrated example foot support structure 200, however, gas from solenoid valve 220 does not go directly into the heel based fluid-filled bladder 202H and/or directly into the forefoot based fluid-filled bladder 202F. Rather, a fluid line 222H supplies gas from the gas outlet 220H of solenoid valve 220 to a solenoid valve 230 for controlling gas flow and gas pressure in the heel based fluid-filled bladder 202H. Solenoid valve 230 includes a gas intake port 230A connected to fluid line 222H (to receive gas from solenoid valve 220) and a gas inlet/outlet port 230B that connects via fluid line 230H to heel based foot support fluid-filled bladder 202H (which may include a gas port 204H). The fluid line 230H may include a two-way valve 230V, which may be electronically controlled (e.g., by controller 250), to control the direction of fluid flow into and out of heel support fluid-filled bladder 202H (e.g., for reasons to be described in more detail below). Solenoid valve 230 of this illustrated example further includes an external gas outlet port 230C that may be in (or may be placed in) fluid communication with the external environment (e.g., the ambient atmosphere, for reasons to be described in more detail below). As some more specific examples, this external gas outlet port 230C may be a simple opening in the solenoid valve 230, a conventional "port" type opening, and/or a fluid line extending to and open to the external environment.

Another fluid line 222F supplies gas from the gas outlet 220F of solenoid valve 220 to a solenoid valve 240 for controlling gas flow and gas pressure in the forefoot based fluid-filled bladder 202F. Solenoid valve 240 includes a gas intake port 240A connected to fluid line 222F (to receive gas from solenoid valve 220) and a gas outlet port 240B that connects via fluid line 240F to forefoot based foot support fluid-filled bladder 202F (which may include a gas port 204F). The fluid line 240F may include a two-way valve 240V, which may be electronically controlled (e.g., by controller 250), to control the direction of fluid flow into and out of forefoot support fluid-filled bladder 202F (e.g., for reasons to be described in more detail below). Solenoid valve 240 of this illustrated example further includes an external gas outlet port 240C that may be in (or may be placed in) fluid communication with the external environment (e.g., the ambient atmosphere, for reasons to be described in more detail below). As some more specific examples, this external gas outlet port 240C may be a simple opening in the solenoid valve 240, a conventional "port" type opening, and/or a fluid line extending to and open to the external environment.

As further shown in FIGS. 1B, 1C, and 2A, if desired, one or more of the components of the foot support system 200 may be mounted on a base plate 120 (e.g., a bracket), which in turn may be mounted to the footwear upper 102 and/or the footwear sole structure 104 (e.g., by adhesives or mechanical connectors). The base plate 120 may be made of plastic, fabric, metal, and/or any other desired material(s).

Foot support systems 200 in accordance with at least some examples of this invention may include other components or elements as well. For example, as shown in FIGS. 1B-2A, this example foot support system 200 includes a controller 250, e.g., for controlling operation of one or more of the compressor 210, the first solenoid valve 220 (or main control solenoid valve), the second solenoid valve 230 (or heel support fluid-filled bladder control solenoid valve), the third solenoid valve 240 (or forefoot support fluid-filled bladder control solenoid valve), the two-way valve 230V, and/or the two-way valve 240V, etc. The controller 250 may constitute a programmable controller (e.g., having one or more microprocessors) as are known and commercially available, and which may be programmed and adapted to operate in one or more of the manners described in more detail below.

Any desired types of fluid line(s) (e.g., lines 212, 222H, 222F, 230H, and/or 240F) may be used without departing from this invention, including plastic tubing, channels formed in another component (such as in a foam midsole material, an upper material, etc.), etc. The gas ports (e.g., intake ports and/or outlet ports, such as ports 210A, 210B, 220A, 220H, 220F, 230A, 230B, 230C, 240A, 240B, 240C, 204H, 204F, etc.) may have any desired construction(s) and/or structure(s) without departing from this invention, including openings, ports, or stems to which plastic tubing is attached, as are known and used in the fluid-transmission arts. The fluid line(s) may be permanently fixed and/or releasable fixed to their respective port(s) without departing from the invention.

A pressure sensor 260H is provided in this illustrated example for determining pressure in the heel based fluid-filled bladder 202H, and this pressure sensor 260H (which may be located, for example, within the fluid-filled bladder 202H and/or along fluid line 230H) provides sensed pressure information in fluid-filled bladder 202H to the controller 250 (e.g., via electronic communication line 262H). Additionally or alternatively, a pressure sensor 260F may be provided for determining pressure in the forefoot based fluid-filled bladder 202F, and this pressure sensor 260F (which may be located, for example, within the fluid-filled bladder 202F and/or along fluid line 240F) provides sensed pressure information in fluid-filled bladder 202F to the controller 250 (e.g., via electronic communication line 262F).

As further shown in these figures, in accordance with at least some examples of this invention, the foot support system 200 may include an input device 270, e.g., for receiving input data in electronic communication with the controller 250. Any desired type of input device 270 may be used without departing from this invention, including any desired type of wired or wireless input device (e.g., a wireless transceiver, a USB port, etc.) that operates under any desired type of wired or wireless communication protocol (e.g., a BLUETOOTH® type transmission system/protocol (available from Bluetooth SIG, Inc.), infrared transmissions, optical fiber transmissions, etc.). As further shown in FIGS. 1B-2A, the input device 270 may be in electronic communication (illustrated by transmission icon 272) with an electronic communication device 280. The electronic communication device 280 (which may include at least one member selected from the group consisting of: a personal computer, a laptop computer, a desktop computer, a tablet computer, a mobile telephone, and/or other mobile communication device, etc.) may receive user input via an input system 282 (e.g., a keyboard, a touch screen, one or more switches, etc.). As some more specific examples, the electronic communication device 280 and/or the input device 270 may be used to receive and transmit user input including at least one of: (a) a desired pressure level for one or more fluid-filled bladders (e.g., fluid-filled bladders 202H and/or 202F) and/or (b) a desire to change pressure in one or more fluid-filled bladders (e.g., fluid-filled bladders 202H and/or 202F), e.g., to increase or decrease pressure by a set amount (such as ±0.1 psi, ±0.2 psi, etc.).

Figure 2B:
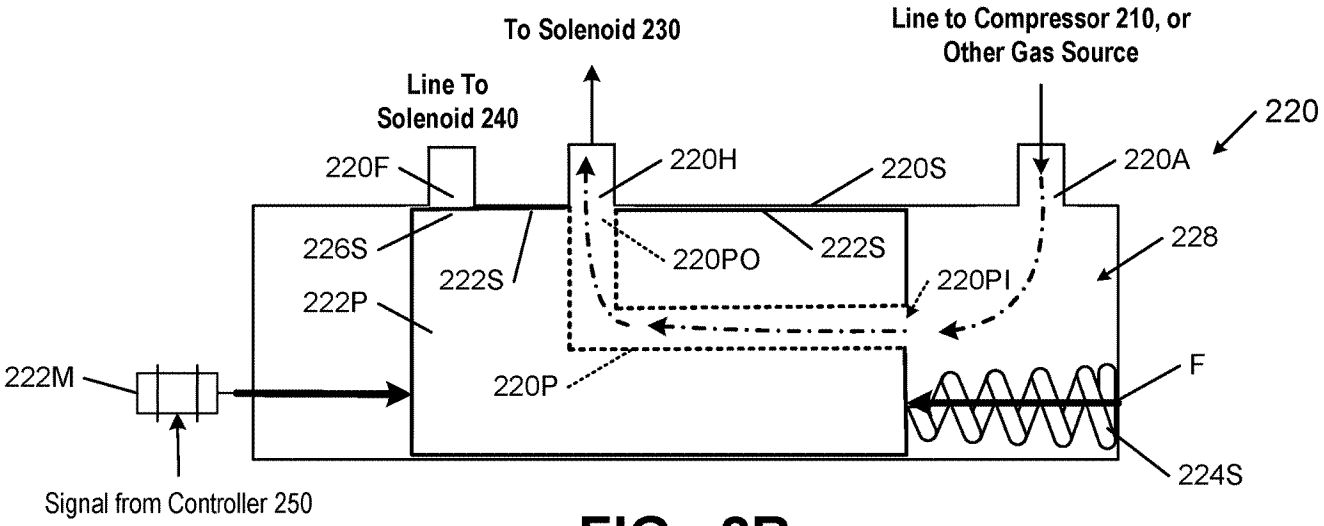
FIGS. 2B and 2C provide views illustrating example operation and configurations of one inflation controlling component (e.g., a solenoid valve) in accordance with at least some examples of this invention.
Figure 2C:
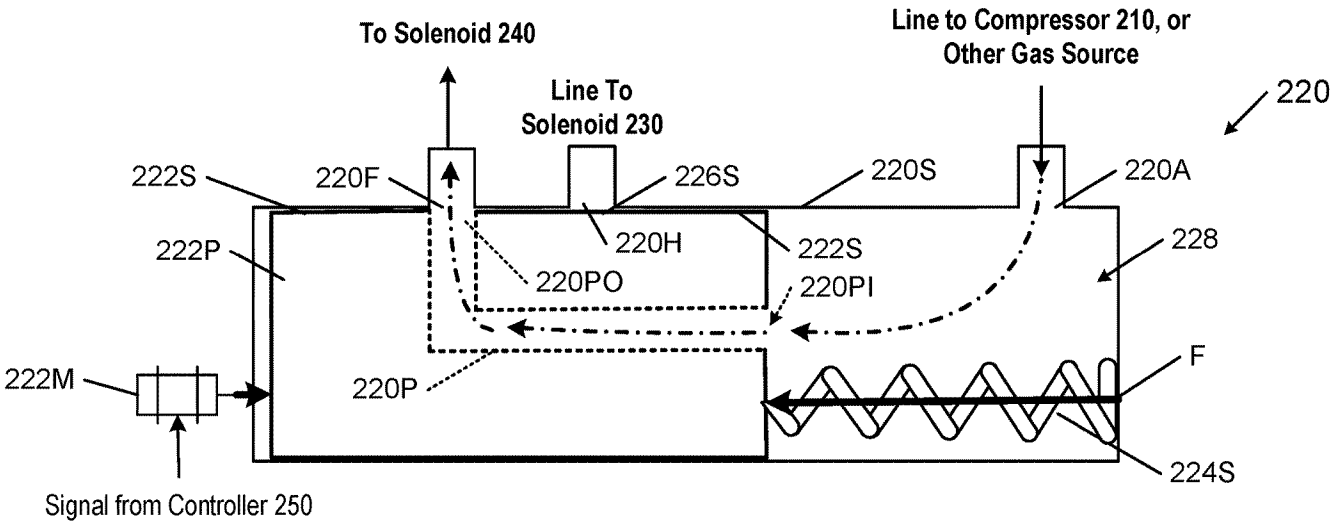

FIGS. 2B and 2C illustrate example structures and operations of solenoid valve 220 that is directly connected to compressor 210 and the solenoid valves 230 and 240 in this example foot support system 200. FIG. 2B illustrates the solenoid valve 220 in a configuration utilized to supply gas to solenoid valve 230 for inflating heel based fluid-filled bladder 202H (e.g., sending gas to gas inlet port 230A of solenoid valve 230). FIG. 2C illustrates the solenoid valve 220 in a configuration utilized to supply gas to solenoid valve 240 for inflating forefoot based fluid-filled bladder 202F (e.g., sending gas to gas inlet port 240A of solenoid valve 240).

As shown in FIGS. 2B and 2C, this example solenoid valve 220 includes a gas intake port 220A that is in fluid communication with a gas source, such as the gas outlet port 210B of the compressor 210 (e.g., via fluid line 212). A one-way valve 212V may be provided, e.g., in fluid line 212, optionally under control of controller 250, e.g., to prevent gas flow back into the compressor 210, to control gas flow from the compressor 210, etc. As mentioned above, the solenoid valve 220 further includes: (a) a gas outlet port 220H that is in fluid communication with the heel based fluid-filled bladder 202H (e.g., via solenoid valve 230 and fluid line 222H) and (b) a gas outlet port 220F that is in fluid communication with the forefoot based fluid-filled bladder 202F (e.g., via solenoid valve 240 and fluid line 222F). The solenoid valve 220 of this example further includes a movable plunger 222P that moves to change the solenoid valve 220 at least between the heel based fluid-filled bladder 202H inflation configuration (FIG. 2B) and the forefoot fluid-filled bladder 202F inflation configuration (FIG. 2C). The exterior side wall(s) 222S of the plunger 222P may closely align with the interior side wall(s) 220S of the solenoid valve interior chamber 228 so as to prevent (or substantially prevent) gas transmission around the exterior side wall(s) 222S of the plunger 222P (i.e., gas transfer path(s) 220P may be the only way for gas to pass through the solenoid valve 220). Other sealing components may be provided to seal the plunger 222P along its side wall(s) 222S, if necessary or desired.

Movement and positioning of the plunger 222P of this illustrated example is controlled by: (a) a biasing system (e.g., a spring 224S, etc.), which applies a biasing force F to push the plunger 222P to the left in the orientation of FIGS. 2B-2C and/or (b) a motor 222M, which is capable of moving the plunger 222P against the biasing force F of the spring 224S. The motor 222M may be electronically controlled, e.g., by signals from controller 250 (or other control system). Optionally, when operation of the motor 222M is stopped, the motor 222M and/or solenoid valve 220 may be structured and configured so as to maintain the plunger 222P in its position when the motor 222M stopped. The plunger 222P of this example further includes one or more gas transfer paths 220P, shown in broken lines in FIGS. 2B-2C, to move gas from the gas source (admitted to the solenoid valve 220 via gas inlet port 220A) to the desired solenoid valve 230/240 (and eventually to its respective fluid-filled bladder 202H/202F). The illustrated gas transfer path 220P through plunger 222P in this example has an inlet end 220PI and an outlet end 220PO.

Operation of the solenoid valve 220 in the various configurations now will be explained. As mentioned, FIG. 2B illustrates the solenoid valve 220 in a configuration utilized to supply gas to solenoid valve 230 for inflating heel based fluid-filled bladder 202H (e.g., sending gas to gas inlet port 230A via line 222H). In this example configuration, the biasing system (e.g., spring 224S) and/or motor 222M position the plunger 222P to an orientation at which the outlet 220PO of the gas transfer path 220P aligns with the gas outlet port 220H of solenoid valve 220. Gas (optionally under pressure, e.g., from compressor 210 or other gas source) is admitted to the interior chamber 228 of the solenoid valve 220 via gas inlet port 220A. Because the gas cannot substantially flow around the exterior side wall(s) 222S of the plunger 222P between side wall(s) 222S and 220S, the gas enters the gas transfer path 220P inlet 220PI, passes through the path 220P, to the outlet 220PO, through gas outlet port 220H, and to the connected solenoid valve 230 (note the "dot-dash" gas flow arrows shown in FIG. 2B). Example operation of solenoid valve 230 is described in more detail below.

In the arrangement shown in FIG. 2B, access to the gas outlet port 220F may be sealed, e.g., by a seal structure (226S), by a close fit between the exterior side wall(s) 222S of plunger 222P and the interior side wall(s) 220S of the solenoid valve 220, etc. Additionally or alternatively, if the seal between side wall(s) 222S and 220S is adequate, no separate seal at outlet port 220F may be needed.

To change the solenoid valve 220 between the heel based fluid-filled bladder 202H inflation configuration shown in FIG. 2B to the forefoot based fluid-filled bladder 202F inflation configuration shown in FIG. 2C, the controller 250 may activate motor 222M and/or utilize the biasing force F of the biasing system (e.g., spring 224S) to move the plunger 222P to the configuration shown in FIG. 2C. In this configuration, the plunger 222P moves so that the outlet 220PO of the gas transfer path 220P moves away from gas outlet port 220H, and optionally, a seal 226S may be provided with or as part of the plunger 222P (e.g., a close fit between the exterior side wall(s) 222S of plunger 222P and the interior side wall(s) 220S of the solenoid valve 220S) to seal off the outlet port 220H and/or the fluid line 222H to solenoid valve 230. Also, in the configuration shown in FIG. 2C, the biasing system (e.g., spring 224S) and/or motor 222M position the plunger 222P to an orientation at which the outlet 220PO of the gas transfer path 220P aligns with the gas outlet port 220F of solenoid valve 220. Gas (optionally under pressure, e.g., from compressor 210 or other gas source) is admitted to the interior chamber 228 of the solenoid valve 220 via gas inlet port 220A. Because the gas cannot substantially flow around the exterior side wall(s) 222S of the plunger 222P between side wall(s) 222S and 220S, the gas enters the gas transfer path 220P inlet 220PI, passes through the path 220P, to the outlet 220PO, through gas outlet port 220F, and to the connected solenoid valve 240 (note the "dot-dash" gas flow arrows shown in FIG. 2C). Example operation of solenoid valve 240 is described in more detail below.

The controller 250, motor 222M, and/or the biasing system (e.g., spring 224S) also can be used to change the plunger 222P between the position shown in FIG. 2C to the position shown in FIG. 2B (e.g., to switch the system from inflating forefoot based fluid-filled bladder 202F (FIG. 2C) to inflating heel based fluid-filled bladder 202H (FIG. 2B), e.g., by running motor 222M in the reverse direction, by allowing biasing system (e.g., spring 224S) move the plunger 222P, etc.

Figure 2D:
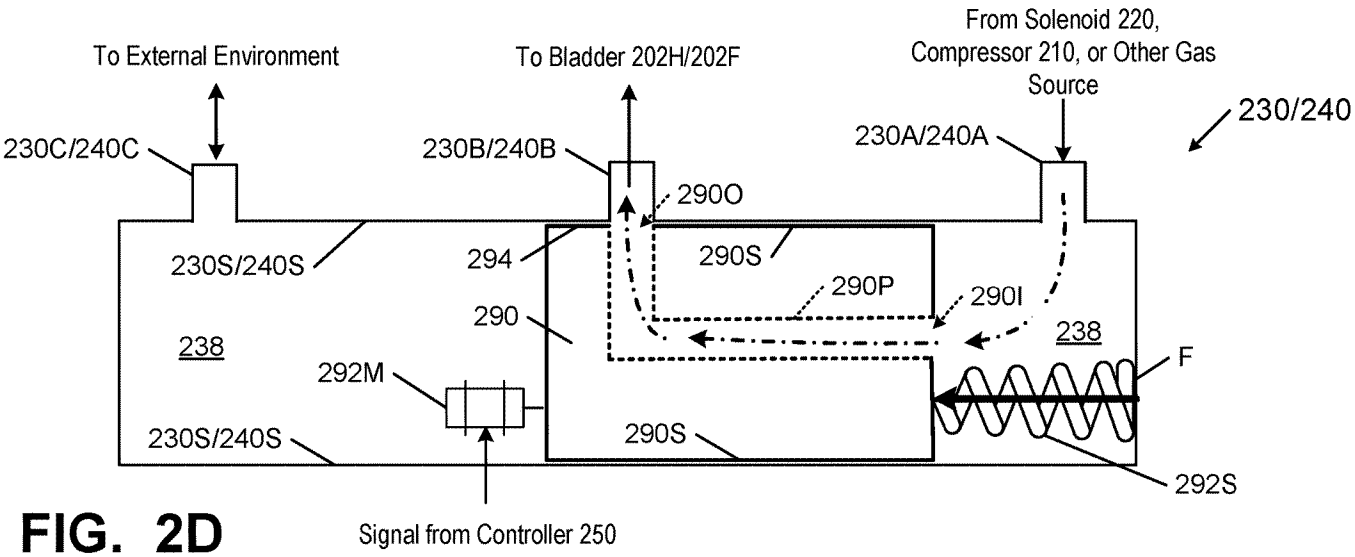
FIGS. 2D-2F provide views illustrating example operation and configurations of other inflation controlling components (e.g., a solenoid valve) in accordance with at least some examples of this invention.
Figure 2E:
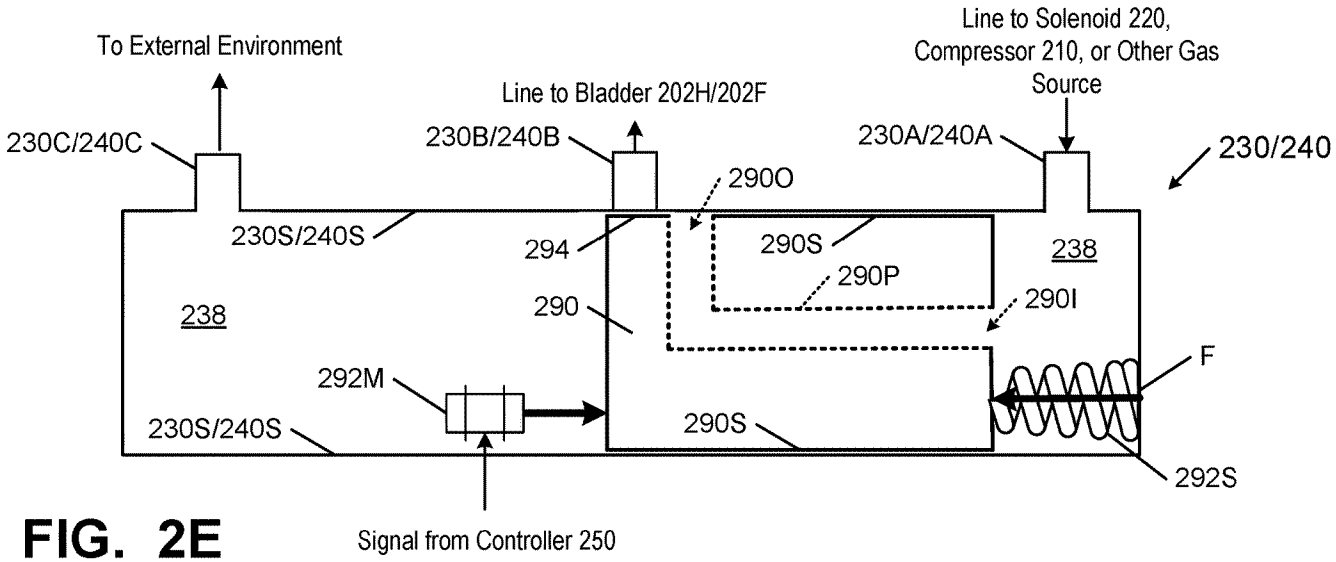
Figure 2F:
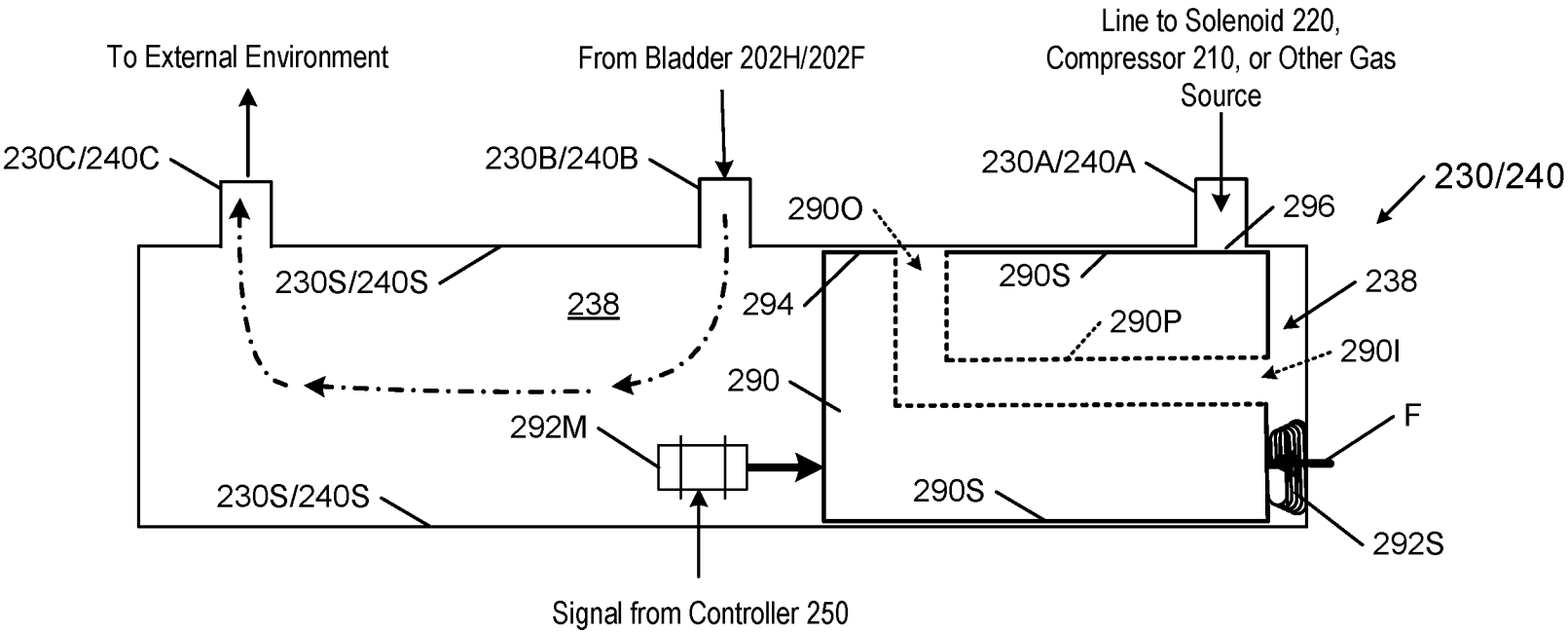

FIGS. 2D-2F illustrate example structures and operations of solenoid valves 230/240 that are directly connected to the fluid-filled bladders 202H/202F in this example foot support system 200. The structures and operations described below in conjunction with FIGS. 2D-2F may apply to either of solenoid valves 230 or 240 individually, or both solenoid valves 230 and 240 may have the same structures and/or operation. FIG. 2D illustrates the solenoid valve 230/240 in an "inflation configuration" in which gas is supplied to the connected fluid-filled bladder 202H/202F (through gas inlet/outlet port 230B/240B and fluid lines 230H/240F); FIG. 2E illustrates the solenoid valve 230/240 in a "pressure maintain configuration" in which gas pressure in the associated fluid-filled bladder 202H/202F is maintained substantially constant; and FIG. 2F illustrates the solenoid valve 230/240 in a "deflation configuration" in which gas is released from the connected fluid-filled bladder 202H/202F (through gas inlet/outlet port 230B/240B and gas outlet port 230C/240C). Additionally or alternatively, if desired, the "pressure maintain configuration" could be managed, fully or in part, by two-way valves 230V/240V (optionally with the valve(s) 230V/240V under electronic control, e.g., by controller 250).

As shown in FIGS. 2D-2F, the solenoid valve 230/240 includes a gas intake port 230A/240A that is in fluid communication with a gas source, such as the gas outlet port 210B of the compressor 210 and/or the gas outlet port 220H/220F of solenoid valve 220 (e.g., via fluid lines 222H/222F). As mentioned above, the solenoid valve 230/240 further includes: (a) a gas inlet/outlet port 230B/240B, which is in fluid communication with its respective fluid-filled bladder 202H/202F (e.g., via line 230H/240F) and (b) a gas outlet port 230C/240C, which is in fluid communication with the external environment in this illustrated example. The solenoid valve 230/240 of this example further includes a movable plunger 290 that moves to change the solenoid valve 230/240 at least between the inflation configuration (FIG. 2D) and the deflation configuration (FIG. 2F), and optionally, to the gas pressure maintain configuration (FIG. 2E). The exterior side wall(s) 290S of the plunger 290 may closely align with the interior side wall(s) 230S/240S of the solenoid valve interior chamber 238 so as to prevent (or substantially prevent) gas transmission around the exterior side wall(s) 290S of the plunger 290 (i.e., gas transfer path(s) 290P may be the only way for gas to pass through the solenoid valve 230/240). If necessary or desired, other sealing structures can be provided to seal and prevent gas flow between side wall(s) 290S and side wall(s) 230S/240S.

Movement and positioning of the plunger 290 of this illustrated example solenoid 230/240 is controlled by: (a) a biasing system (e.g., a spring 292S, etc.), which applies a biasing force F to push the plunger 290 to the left in the orientation of FIGS. 2D-2F and/or (b) a motor 292M, which is capable of moving the plunger 290 against the biasing force F of the spring 292S. The motor 292M may be electronically controlled, e.g., by signals from controller 250 (or other control system) in a manner to be described in more detail below. Optionally, when operation of the motor 292M is stopped, the motor 292M and/or solenoid valve 230/240 may be structured and configured so as to maintain the plunger 290 in its position when the motor 292M stopped. The plunger 290 of this example further includes one or more gas transfer paths 290P, shown in broken lines in FIGS. 2D-2F, to move gas from the gas source (admitted to the solenoid valve 230/240 via gas inlet port 230A/240A) to its respective fluid-filled bladder 202H/202F (transmitted from the solenoid valve 230/240 via gas inlet/outlet port 230B/240B). The illustrated gas transfer path 290P through plunger 290 has an inlet end 290I and an outlet end 290O.

Operation of the solenoid valve 230/240 in the various configurations now will be explained. As mentioned, FIG. 2D illustrates the solenoid valve 230/240 in an "inflation configuration." In this example configuration, the biasing system (e.g., spring 292S) pushes the plunger 290 to is maximum extent (by biasing force F). At this orientation, the outlet 290O of the gas transfer path 290P aligns with the gas inlet/outlet port 230B/240B. Gas (optionally under pressure, e.g., from compressor 210, solenoid valve 220, or other gas source) is admitted to the interior chamber 238 of the solenoid valve 230/240 via gas inlet port 230A/240A. Because the gas cannot substantially flow around the exterior side wall(s) 290S of the plunger 290, the gas enters the gas transfer path 290 inlet 290I, passes through the path 290, to the outlet 290O, through gas inlet/outlet port 230B/240B, and to the connected fluid-filled bladder 202H/202F (note the "dot-dash" gas flow arrows shown in FIG. 2D).

Once the gas in the fluid-filled bladder 202H/202F reaches a desired pressure level (e.g., as measured by pressure sensors 260H/260F and/or set by input system 282), the controller 250 may activate motor 292M to move the plunger 290 against the biasing force F of the biasing system (e.g., spring 292S) to the gas "pressure maintain configuration" shown in FIG. 2E. In the "pressure maintain configuration" of FIG. 2E, the plunger 290 moves so that the outlet 290O of the gas transfer path 290P moves away from gas inlet/outlet port 230B/240B, and optionally, a seal 294 may be provided with or as part of the plunger 290 to seal off the inlet/outlet port 230B/240B and/or the line to fluid-filled bladder 202H/202F. Additionally or alternatively, if desired, the controller 250 could control the compressor 210 and/or the solenoid valve 220 to stop supplying gas to the solenoid valve 230/240 and/or the controller 250 could close two-way valve(s) 230V/240V to stop further gas pressure increase or decrease in the fluid-filled bladders 202H/202F. The seal 294, when used, maintains the pressure in the fluid-filled bladder 202H/202F at a constant (or substantially constant) pressure. The term "substantially constant pressure" as used herein in this context, means that the gas pressure in the fluid-filled bladder 202H/202F is maintained constant for at least a 2 minute time period and/or the fluid-filled bladder 202H/202F loses less than 5% of its pressure over a 2 minute time period. If engagement between side wall(s) 290S and side wall(s) 230S/240S is sufficiently tight and sealing, a separate seal component 294 may be unnecessary. If/when it becomes necessary to increase gas pressure in fluid-filled bladder 202H/202F (e.g., based on a pressure reading by sensor 260H/260F, based on user input via input system 282, etc.), the solenoid valve 230/240 can be controlled (e.g., by controller 250) to return to the configuration of FIG. 2D (by activating motor 292M and/or relying on biasing system 292S), and additional gas can be transmitted into the fluid-filled bladder 202H/202F until it reaches the desired pressure.

If/when it becomes necessary to decrease gas pressure in fluid-filled bladder 202H/202F (e.g., based on a pressure reading by sensor 260H/260F, based on user input via input system 282, etc.), the solenoid valve 230/240 can be changed to the deflation configuration of FIG. 2F. This may be accomplished by activating motor 292M to move the plunger 290 against the biasing force F of the biasing system (e.g., spring 292S), e.g., as shown in FIG. 2F. In this configuration, the plunger 290 moves so that the seal 294 moves away from the gas inlet/outlet port 230B/240B. This movement places the fluid-filled bladder 202H/202F in fluid communication with the interior chamber 238 of the solenoid valve 230/240 (via gas inlet/outlet port 230B/240B), which in turn is in fluid communication with the external environment (via external port 230C/240C). In this manner, gas from the fluid-filled bladder 202H/202F may be vented to the external environment through solenoid valve 230/240 (as shown by the "dot-dash" lines in FIG. 2F). Optionally, as shown in FIG. 2F, the solenoid valve 230/240 may include a seal 296 to seal off the gas inlet port 230A/240A (or, if engagement between side wall(s) 290S and side wall(s) 230S/240S is sufficiently tight and sealing, a separate sealing component 296 may be unnecessary). Once the gas pressure in fluid-filled bladder 202H/202F reaches a desired pressure level (e.g., as noted by a pressure sensor 260H/260F reading), the solenoid valve 230/240 can be controlled (e.g., by controller 250) to return to the pressure maintain configuration of FIG. 2E (by activating motor 292M and/or relying on biasing system 292S), and the gas inlet/outlet port 230B/240B can again be sealed by seal 294 (or sealing engagement of side wall(s) 290S with side wall(s) 230S/240S). Additionally or alternatively, if desired, once the desired pressure is reached in the fluid-filled bladder 202H/202F, the valve 230V/240V can be closed to prevent further gas flow out of fluid-filled bladder 202H/202F.

Figure 3:
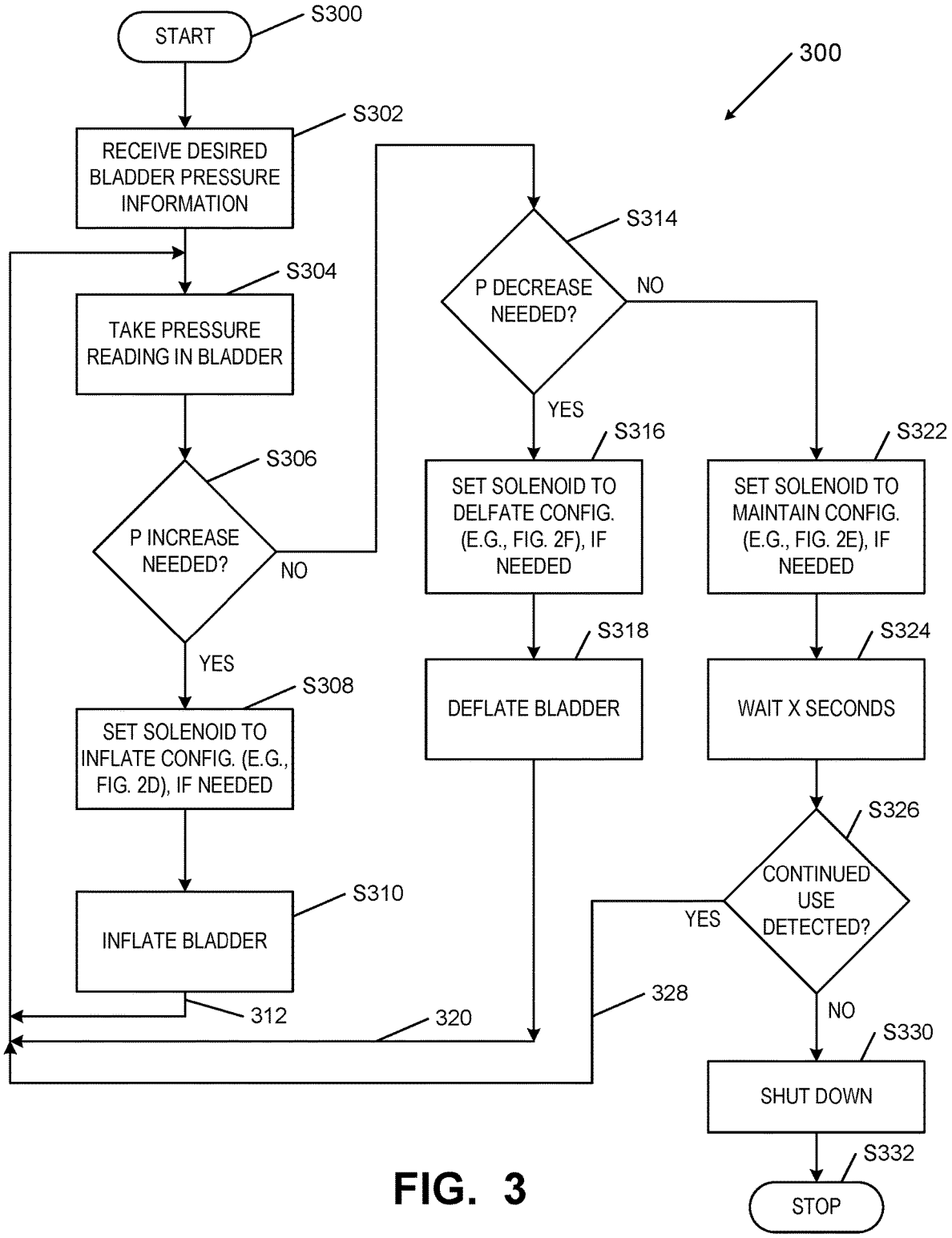
FIG. 3 provides a flow diagram illustrating example operation of an inflation control system in accordance with at least some examples of this invention.

FIG. 3 is a flow chart illustrating one example of the manner in which operation of solenoid valve 230 and/or 240 may be controlled (e.g., using controller 250) in at least some examples of this invention in order to control fluid pressure in fluid-filled bladder 202H and/or 202F. As shown in FIG. 3, in this example, the process 300 starts (S300), e.g., when the foot support system 200 is powered on, when the foot support system 200 wakes up from a "sleep" mode, when a foot is detected in the foot-receiving chamber of the shoe, etc. As a first step S302 in this process, the controller 250 or input 270 may receive information regarding the desired gas pressure in the fluid-filled bladder being controlled. This information may come, for example, from memory relating to a previous setting for that fluid-filled bladder, from a default pressure setting set in the foot support system 200, from user input via input system 282/electronic communication device 280, from user input indicating an absolute value for the desired pressure (e.g., from 20 psi to 30 psi), from user input indicating a desire to increase or decrease the pressure in the fluid-filled bladder (e.g., ±0.1 psi, ±0.2 psi, etc.), etc. The desired bladder pressure information may be stored in memory, e.g., provided with or in communication with the controller 250.

The controller 250 of this example system and method then takes pressure readings from the fluid-filled bladder (e.g., via pressure sensor 260H or 260F, Step S304). Based on the pressure reading at Step S304 and the desired bladder pressure information obtained at S302, systems and methods according to at least some aspects of this invention can determine whether pressure needs to be adjusted in the fluid-filled bladder 202H/202F, and the flowchart of FIG. 3 provides one example process for doing so. More specifically, at Step S306, this example system and method compares the actual measured bladder pressure with the desired bladder pressure stored in memory and determines if a pressure increase is needed in the fluid-filled bladder 202H/202F to place the bladder pressure at the desired level (or within a predetermined range from the desired pressure level). If "yes," then at Step S308, the controller 250 sets the solenoid valve 230 or 240 to an "inflate" configuration (e.g., the configuration shown in FIG. 2D) and begins inflating the fluid-filled bladder 202H/202F (Step S310). After a desired inflation time period, this example system and method then return to Step S304 (via process line 312) where the pressure in the fluid-filled bladder 202H/202F is again measured and the process repeats.

If at Step S306 it is determined that no pressure increase is needed in the fluid-filled bladder 202H/202F to reach the desired pressure level (answer "no"), this example system and method then determine at Step S314 whether a pressure decrease is needed in the fluid-filled bladder 202H/202F to place the bladder pressure at the desired level (or within a predetermined range from the desired pressure level). If "yes," then at Step S316, the controller 250 sets the solenoid valve 230 or 240 to a "deflate" configuration (e.g., the configuration shown in FIG. 2F) and begins deflating the fluid-filled bladder 202H/202F (Step S318). After a desired deflation time period, this example system and method then return to Step S304 (via process line 320) where the pressure in the fluid-filled bladder 202H/202F is again measured and the process repeats.

If at Step S314 it is determined that no pressure decrease is needed in the fluid-filled bladder 202H/202F to reach the desired pressure level (answer "no"), then this example system and method consider that the fluid-filled bladder 202H/202F is at the desired pressure level (e.g., within a predetermined pressure range of the pressure level received at Step S302). In this event, the solenoid valve 230 or 240 being controlled then may be set to its "pressure maintain" configuration (e.g., the configuration shown in FIG. 2E) at Step S322. Additionally or alternatively, if desired, the pressure may be maintained in the fluid-filled bladder 202H/202F (e.g., constant or substantially constant) by closing two-way valve 230V/240V. As shown at Step S324, systems and methods according to this example of the invention may wait a predetermined time period and then determine whether use of the foot support system 200 continues (Step S326). This may be accomplished, for example, by input from one or more of a motion detector (e.g., an accelerometer or gyroscope type detector) to determine if the shoe is moving, a heat sensor (e.g., infrared detector confirming the presence of a foot in the shoe), a foot force detector (e.g., to determine external force on the fluid-filled bladder 202H/202F), or in any other desired manner. If continued use is detected (answer "yes" at Step S326), this example system and method may return to Step S304 (via process line 328) where the pressure in the fluid-filled bladder 202H/202F is again measured and the process repeats. If continued use is not detected at Step S326, this example system and method then may shut down the system (e.g., power off, go in a "sleep" mode, increase a time period before returning to Step S304, etc.) in order to preserve battery power at Step S330, and the process eventually may stop (S332), e.g., at least until renewed use is detected (e.g., as a result of a signal from a motion detector, a heat sensor, a foot force detector, etc.; input from electronic communication device 280; input via input device 270; physically pushing an "ON" or "wake up" button; and/or in any other desired manner).

While FIG. 3 provides one example of steps that may be used to determine, adjust, and/or maintain pressure in one or more fluid-filled bladders (e.g., 202H and/or 202F), those skilled in the art, given benefit of this disclosure, will recognize that other methods, steps, orders of steps, and the like may be used to determine, adjust, and/or maintain pressure in one or more fluid-filled bladders (e.g., 202H and/or 202F) without departing from this invention. Additionally or alternatively, other types of electronically controlled valves, pressure measuring devices, and the like may be used without departing from the invention.

Figure 4A:
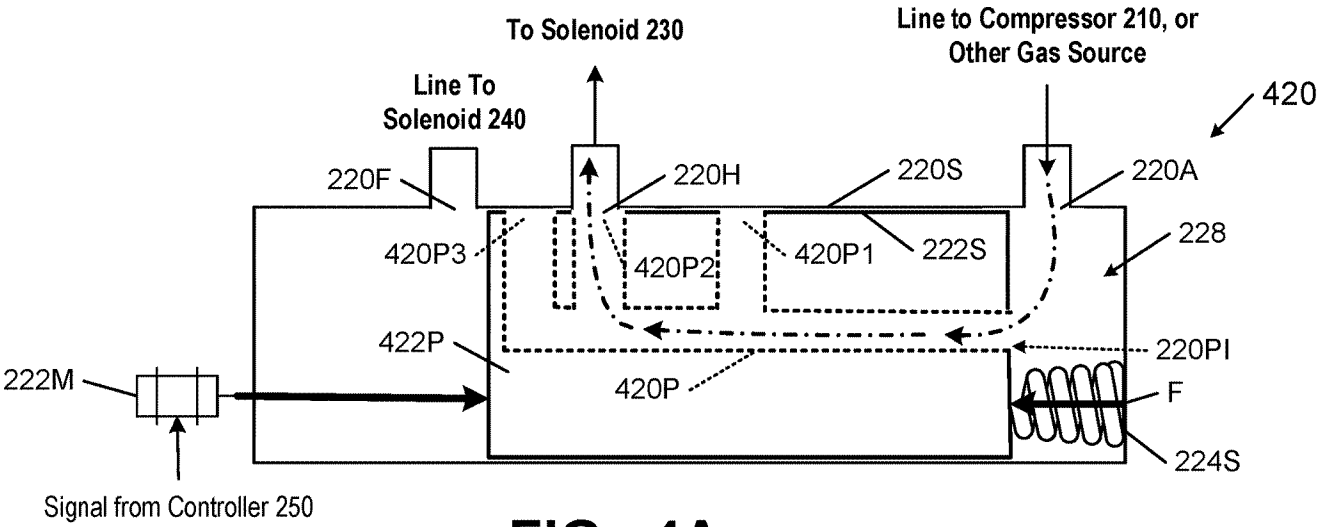
FIGS. 4A-4C provide views illustrating example operation and configurations of another example inflation controlling component (e.g., a solenoid valve) in accordance with at least some examples of this invention.
Figure 4B:
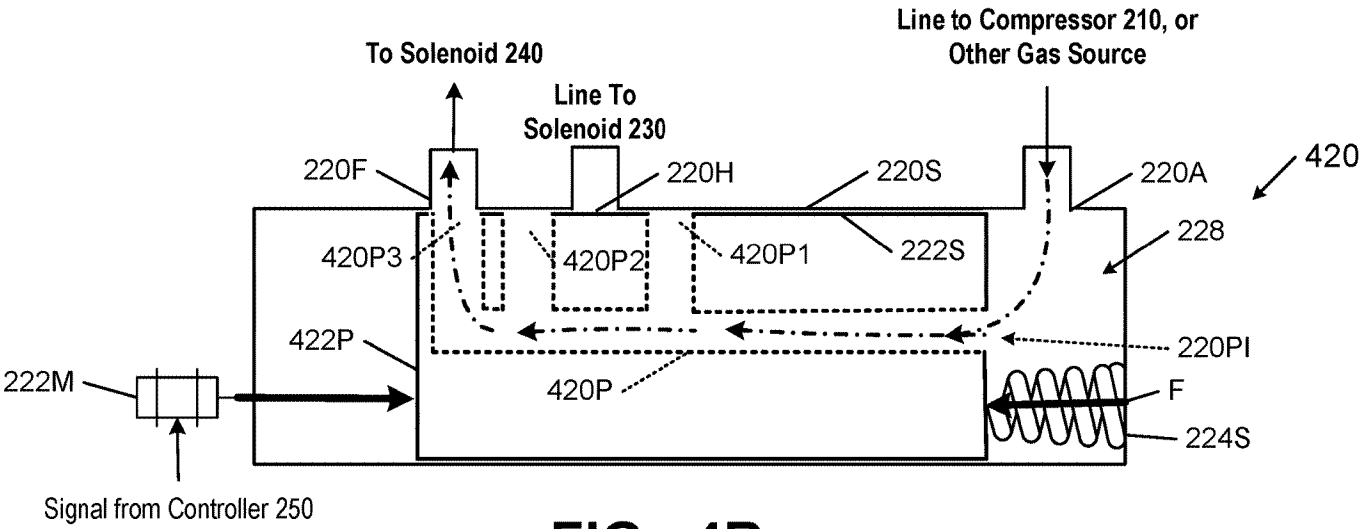
Figure 4C:
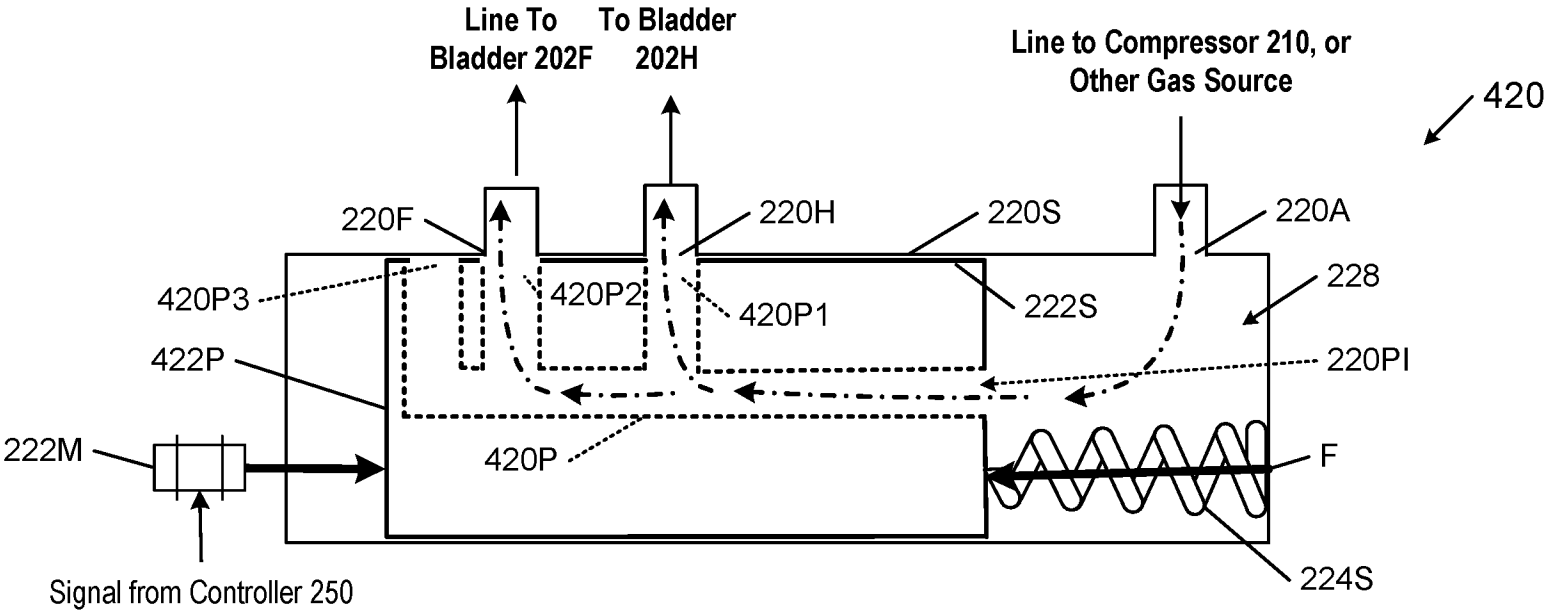

FIGS. 4A-4C illustrate another example structure of a solenoid valve 420 that is similar in structure and/or function to solenoid valve 220, but is convertible between three different configurations, namely: (a) a configuration for inflating only heel based fluid-filled bladder 202H (FIG. 4A), e.g., via solenoid valve 230, (b) a configuration for inflating only forefoot based fluid-filled bladder 202F (FIG. 4B), e.g., via solenoid valve 240, and (c) a configuration for inflating both heel based fluid-filled bladder 202H and forefoot based fluid-filled bladder 202F simultaneously (FIG. 4C), e.g., via solenoid valves 230 and 240. Like reference numbers in FIGS. 4A-4C represent like parts as those from the other examples and embodiments described above. One difference between this example solenoid valve 420 and the solenoid valve 220 shown in FIGS. 2B-2C relates to the gas transfer path 420P through the plunger 422P. Rather than a single outlet port 220PO from the gas transfer path 220P as shown in FIGS. 2B and 2C, plunger 422P of FIGS. 4A-4C includes three outlet ports 420P1, 420P2, and 420P3 from gas transfer path 420P. While one gas inlet port 220PI is shown into the gas transfer path 420P, two or more gas inlet ports and/or two or more separate gas transfer paths could be provided without departing from this invention.

In the configuration shown in FIG. 4A, outlet port 420P2 aligns with outlet port 220H and fluid line 222H to supply gas to solenoid valve 230 and outlet ports 420P1 and 420P3 are sealed (e.g., by a seal structure, by a close fit between interior side wall(s) 220S of solenoid valve 420 and exterior side wall(s) 222S of plunger 422P, or other structure). In this manner, gas is supplied only to solenoid valve 230 for potentially inflating heel based fluid-filled bladder 202H.

In the configuration shown in FIG. 4B, the plunger 422P is moved leftward as compared to its orientation in FIG. 4A and outlet port 420P3 aligns with gas outlet port 220F and fluid line 222F to supply gas to solenoid valve 240 and outlet ports 420P1 and 420P2 are sealed (e.g., by a seal structure, by a close fit between interior side wall(s) 220S of solenoid valve 420 and exterior side wall(s) 222S of plunger 422P, or other structure). In this manner, gas is supplied only to solenoid valve 240 for potentially inflating forefoot based fluid-filled bladder 202F.

In the configuration shown in FIG. 4C, the plunger 422P is moved leftward as compared to its orientation in FIG. 4B and outlet port 420P1 aligns with gas outlet port 220H and fluid line 222H to supply gas to solenoid valve 230, outlet port 420P2 aligns with gas outlet port 220F and fluid line 222F to supply gas to solenoid valve 240, and outlet port 420P3 is sealed (e.g., by a seal structure, by a close fit between interior side wall(s) 220S of solenoid valve 420 and exterior side wall(s) 222S of plunger 422P, or other structure). In this manner, gas is simultaneously supplied to solenoid valve 230 for potentially inflating heel based fluid-filled bladder 202H and to solenoid valve 240 for potentially inflating forefoot based fluid-filled bladder 202F. Controller 250, motor 222M, and/or biasing system 224S may be controlled/used to move plunger 422P between the positions shown in FIGS. 4A-4C.

Other solenoid valve structures, gas paths, fluid lines, and/or components may be used to selectively supply gas from compressor 210 to the fluid-filled bladders 202H and/or 202F, individually or simultaneously, without departing from this invention. As some more specific examples, rather than solenoid valves as described above, any one or more of the solenoid valves may be replaced by other types of valves or other types of "fluid-flow control devices," including other types of programmable and/or electronically controllable valves or other programmable fluid-flow control devices.

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A foot support system for an article of footwear, the foot support system comprising:

a compressor including a gas intake port and a gas outlet port;

a first solenoid valve including: (i) a first gas intake port in fluid communication with the gas outlet port of the compressor, (ii) a first gas outlet port, and (iii) a second gas outlet port;

a second solenoid valve including: (i) a second gas intake port in fluid communication with the first gas outlet port of the first solenoid valve, and (ii) a first gas inlet/outlet port, wherein the second solenoid valve includes a first movable plunger that is configured to move to change the second solenoid valve at least between an inflation configuration and a deflation configuration;

a first fluid-filled bladder configured to support a first portion of a plantar surface of a user's foot, wherein the first fluid-filled bladder includes a first gas port in fluid communication with the first gas inlet/outlet port of the second solenoid valve;

a third solenoid valve including: (i) a third gas intake port in fluid communication with the second gas outlet port of the first solenoid valve, and (ii) a second gas inlet/outlet port, wherein the third solenoid valve includes a second movable plunger that is configured to move to change the third solenoid valve at least between an inflation configuration and a deflation configuration; and a second fluid-filled bladder configured to support a second portion of the plantar surface of the user's foot, wherein the second fluid-filled bladder includes a second gas port in fluid communication with the second gas inlet/outlet port of the third solenoid valve.

2. The foot support system according to claim 1, further comprising:

a controller for controlling operation of the compressor and the second solenoid valve; and a pressure sensor for determining pressure in the first fluid-filled bladder and providing sensed pressure information to the controller.

3. The foot support system according to claim 2, further comprising:

an input device for receiving input data in electronic communication with the controller, wherein the input device is configured to receive user input including at least one of: (a) a desired pressure level for the first fluid-filled bladder and (b) a desire to change pressure in the first fluid-filled bladder.

4. The foot support system according to claim 1, further comprising:

a controller for controlling operation of the compressor and the second solenoid valve; and an input device for receiving input data in electronic communication with the controller, wherein the input device is configured to receive user input including at least one of: (a) a desired pressure level for the first fluid-filled bladder or (b) a desire to change pressure in the first fluid-filled bladder.

5. The foot support system according to claim 1, wherein the first movable plunger is further movable to change the second solenoid valve to a pressure maintain configuration in which gas pressure in the first fluid-filled bladder is maintained substantially constant.

6. The foot support system according to claim 1, wherein the second solenoid valve further includes a gas discharge port in fluid communication with an external environment at which the foot support system is located.

7. The foot support system according to claim 1, further comprising:

a controller for controlling operation of the compressor, the second solenoid valve, and the third solenoid valve;

a first pressure sensor for determining pressure in the first fluid-filled bladder and providing sensed pressure information in the first fluid-filled bladder to the controller; and a second pressure sensor for determining pressure in the second fluid-filled bladder and providing sensed pressure information in the second fluid-filled bladder to the controller.

8. The foot support system according to claim 1, further comprising:

a controller for controlling operation of the compressor, the second solenoid valve, and the third solenoid valve; and an input device for receiving input data in electronic communication with the controller, wherein the input device is configured to receive user input including at least one of: (a) a desired pressure level for the first fluid-filled bladder, (b) a desire to change pressure in the first fluid-filled bladder, (c) a desired pressure level for the second fluid-filled bladder, and (d) a desire to change pressure in the second fluid-filled bladder.

9. A foot support system for an article of footwear, the foot support system comprising:

a compressor including a gas intake port and a gas outlet port;

a first solenoid valve including: (i) a first gas intake port in fluid communication with the gas outlet port of the compressor, (ii) a first gas outlet port, and (iii) a second gas outlet port;

a first fluid flow control device in fluid communication with the first gas outlet port of the first solenoid valve, wherein the first fluid flow control device is configured to be changeable at least between an inflation configuration and a deflation configuration;

a first fluid-filled bladder configured to support a first portion of a plantar surface of a user's foot, wherein the first fluid-filled bladder is in fluid communication with the first fluid flow control device, wherein the first fluid-filled bladder receives gas from the first fluid flow control device when the first fluid flow control device is in the inflation configuration, and wherein the first fluid-filled bladder discharges gas when the first fluid flow control device is in the deflation configuration;

a second fluid flow control device in fluid communication with the second gas outlet port of the first solenoid valve, wherein the second fluid flow control device is configured to be changeable at least between an inflation configuration and a deflation configuration; and a second fluid-filled bladder configured to support a second portion of the plantar surface of the user's foot, wherein the second fluid-filled bladder is in fluid communication with the second fluid flow control device, wherein the second fluid-filled bladder receives gas from the second fluid flow control device when the second fluid flow control device is in the inflation configuration, and wherein the second fluid-filled bladder discharges gas when the second fluid flow control device is in the deflation configuration.

10. The foot support system according to claim 9, further comprising:

a controller for controlling operation of the compressor and the first fluid flow control device; and a pressure sensor for determining pressure in the first fluid-filled bladder and providing sensed pressure information to the controller.

11. The foot support system according to claim 10, further comprising:

an input device for receiving input data in electronic communication with the controller, wherein the input device is configured to receive user input including at least one of: (a) a desired pressure level for the first fluid-filled bladder and (b) a desire to change pressure in the first fluid-filled bladder.

12. The foot support system according to claim 9, further comprising:

a controller for controlling operation of the compressor and the first fluid flow control device; and an input device for receiving input data in electronic communication with the controller, wherein the input device is configured to receive user input including at least one of: (a) a desired pressure level for the first fluid-filled bladder or (b) a desire to change pressure in the first fluid-filled bladder.

13. The foot support system according to claim 9, wherein the first fluid flow control device is additionally configured to be changeable to a pressure maintain configuration in which gas pressure in the first fluid-filled bladder is maintained substantially constant.

14. The foot support system according to claim 9, wherein the first fluid flow control device includes a gas intake port in fluid communication with the first gas outlet port of the first solenoid valve, a gas intake/outlet port in fluid communication with the first fluid-filled bladder, and a gas discharge port in fluid communication with an external environment at which the foot support system is located.

15. The foot support system according to claim 9, further comprising:

a controller for controlling operation of the compressor, the first fluid flow control device, and the second fluid flow control device;

a first pressure sensor for determining pressure in the first fluid-filled bladder and providing sensed pressure information in the first fluid-filled bladder to the controller; and a second pressure sensor for determining pressure in the second fluid-filled bladder and providing sensed pressure information in the second fluid-filled bladder to the controller.

16. The foot support system according to claim 9, further comprising:

a controller for controlling operation of the compressor, the first fluid flow control device, and the second fluid flow control device; and an input device for receiving input data in electronic communication with the controller, wherein the input device is configured to receive user input including at least one of: (a) a desired pressure level for the first fluid-filled bladder, (b) a desire to change pressure in the first fluid-filled bladder, (c) a desired pressure level for the second fluid-filled bladder, and (d) a desire to change pressure in the second fluid-filled bladder.

* * * * *